US005099830A

United States Patent [19]

Kishimoto

[11] Patent Number: 5,099,830

[45] Date of Patent: Mar. 31, 1992

[54] HYDRAULIC BREAST ENHANCER

[75] Inventor: Shunichi Kishimoto, Suita, Japan

[73] Assignee: Azz International Co., Ltd., Osaka, Japan

[21] Appl. No.: 608,276

[22] Filed: Nov. 2, 1990

[30] Foreign Application Priority Data

Nov. 16, 1989 [JP] Japan ..... 1-298521

[51] Int. Cl.[5] ..... A61H 1/00

[52] U.S. Cl. ..... 128/38; 128/66; 239/526

[58] Field of Search ..... 128/24.1, 65, 66, 38, 128/64; 285/396, 401, 402; 239/288.5, 526

[56] References Cited

U.S. PATENT DOCUMENTS

| | | | |
|---|---|---|---|
| 929,112 | 7/1909 | Rider | 128/38 |
| 929,113 | 7/1909 | Rider | 128/38 |
| 946,972 | 1/1910 | Manning | 128/38 |
| 948,005 | 2/1910 | Campbell | 128/38 |
| 2,435,894 | 6/1946 | Marc-Aurele | 128/66 |
| 3,382,867 | 5/1968 | Reaves | 128/38 |
| 3,672,380 | 6/1972 | Schuster | 239/288.5 |
| 4,030,666 | 6/1977 | Gagliardo | 239/526 |
| 4,666,085 | 5/1987 | Liaw | 239/526 |
| 5,011,084 | 3/1991 | Toland | 239/602 |

FOREIGN PATENT DOCUMENTS

| | | | |
|---|---|---|---|
| 538578 | 11/1931 | Fed. Rep. of Germany | 128/38 |

*Primary Examiner*—Robert A. Hafer
*Assistant Examiner*—David J. Kenealy
*Attorney, Agent, or Firm*—William H. Eilberg

[57] ABSTRACT

The present invention provides a hydraulic breast enhancer comprising an applicator cup shaped to receive a user's breast, and a hydraulically operating breast stimulator connected to the cup. The stimulator includes a combination of a negative pressure generator and a water spouting gun. The generator applies a suction force to the cup when water is passed through the generator. The gun is designed to direct water spouts toward the breast when water is supplied to the gun. A changeover valve supplies water to a selected one of the generator and the gun.

10 Claims, 3 Drawing Sheets

HYDRAULIC BREAST ENHANCER

BACKGROUND OF THE INVENTION

1. Field of the Invention

This invention relates generally to pectoral beauty treatment. More specifically, the present invention relates to a breast enhancer which operates by water for enlarging and/or shaping up the breasts of women in particular.

2. Description of the Prior Art

The female breast is one of the external genitalia, and plays an important role in enhancing sexual attractiveness. After parturition (childbirth), the female breast is also used to rear an infant.

From old times, many women have aspired for rich and well-shaped breasts. One method for satisfying such an aspiration is an surgical operation wherein a foreign substance such as silicone resin is injected into the breast. However, such a surgical operation, while effective for improving the breast appearance, is often detrimental to the human health.

In early puberty, the girl's breast becomes richer because the gonadotropic hormone is actively secreted to induce development of the mammary glands and attendant build-up of the breast tissues (mainly fatty tissues). On the other hand, it has been found that secretion of the gonadotropic hormone can be prompted by imparting stimulation to the breast. Therefore, it is possible, at least to a certain extent, to enhance (i.e., enlarge and shape up) the female breast by stimulating it.

In recent years, actually, various beauty culture facilities such as beauty parlors have adopted a breast beauty program wherein the breast is enlarged and/or shaped up by stimulation impartment. Breast stimulation is performed most commonly by manual massage or application of water or air jets for example.

Various breast enhancers have been developed which are designed to enlarge and/or shape up the breast by imparting pressing stimulation. The most preferable of these is the one which applies hydraulic pressing stimulation because a hydraulic breast enhancer is simple in configuration to enable manufacture at a low cost. The hydraulic breast enhancer is also preferable in that it is suitable for home use, particularly for use in a bath room.

Conventional breast enhancers also include those which apply suction stimulation to the breast. Like the pressing stimulation, the suction stimulation has been proven very effective for enlarging and/or shaping up the breast. Further, the application of suction stimulation is medically advisable for training the breast in preparation for the infant's milking suction.

Suction-type breast enhancers according to the prior art equally utilize an electric vacuum pump for generating a negative pressure. Thus, the prior art such-type breast enhancer is inevitably large-sized and costly, consequently limiting its applicability to such facilities which are capable of purchasing and installing such a breast enhancer. Further, the reliance on electricity brings about frequent operating troubles and safety problems.

Indeed, alternate application of suction stimulation and pressing stimulation has been found to provide most effective breast enhancement. Regardless of the operating mechanism or principle, all of the conventional breast enhancers are capable only of providing either pressing stimulation or suction stimulation, thus failing to perform an effective breast enhancement.

SUMMARY OF THE INVENTION

It is, therefore, an object of the present invention to provide a breast enhancer which is capable of selectively imparting suction stimulation and pressing stimulation by a simple changeover operation, thereby effectively performing breast enhancement.

Another object of the present invention is to provide a hydraulic breast enhancer which is simple in structure to enable manufacture at a low cost.

A further object of the present invention is to provide a hydraulic breast enhancer which can be most conveniently used at home, particularly in a bath room.

Still another object of the present invention is to provide a hydraulic breast enhancer which is capable of easily adjusting both of the suction and pressing stimulations.

According to the present invention, there is provided a hydraulic breast enhancer comprising: an applicator cup shaped to receive a user's breast; a negative pressure generator connected to the cup through a suction passage, the generator having a first water passage and being capable of evacuating the interior of the cup when water is passed through the first water passage; a water spouting means connected to the cup and having a second water passage for spouting water toward the breast; and a changeover means connectable to a water supply source, the changeover means being connected to both of the negative pressure generator and the water spouting means for selectively supplying water to the first and second water passages.

Other objects, features and advantages of the present invention will be fully understood from the following detailed description of the preferred embodiment given with reference to the accompanying drawings.

DETAILED DESCRIPTION OF THE PREFERRED EMBODIMENT

Figure 1:
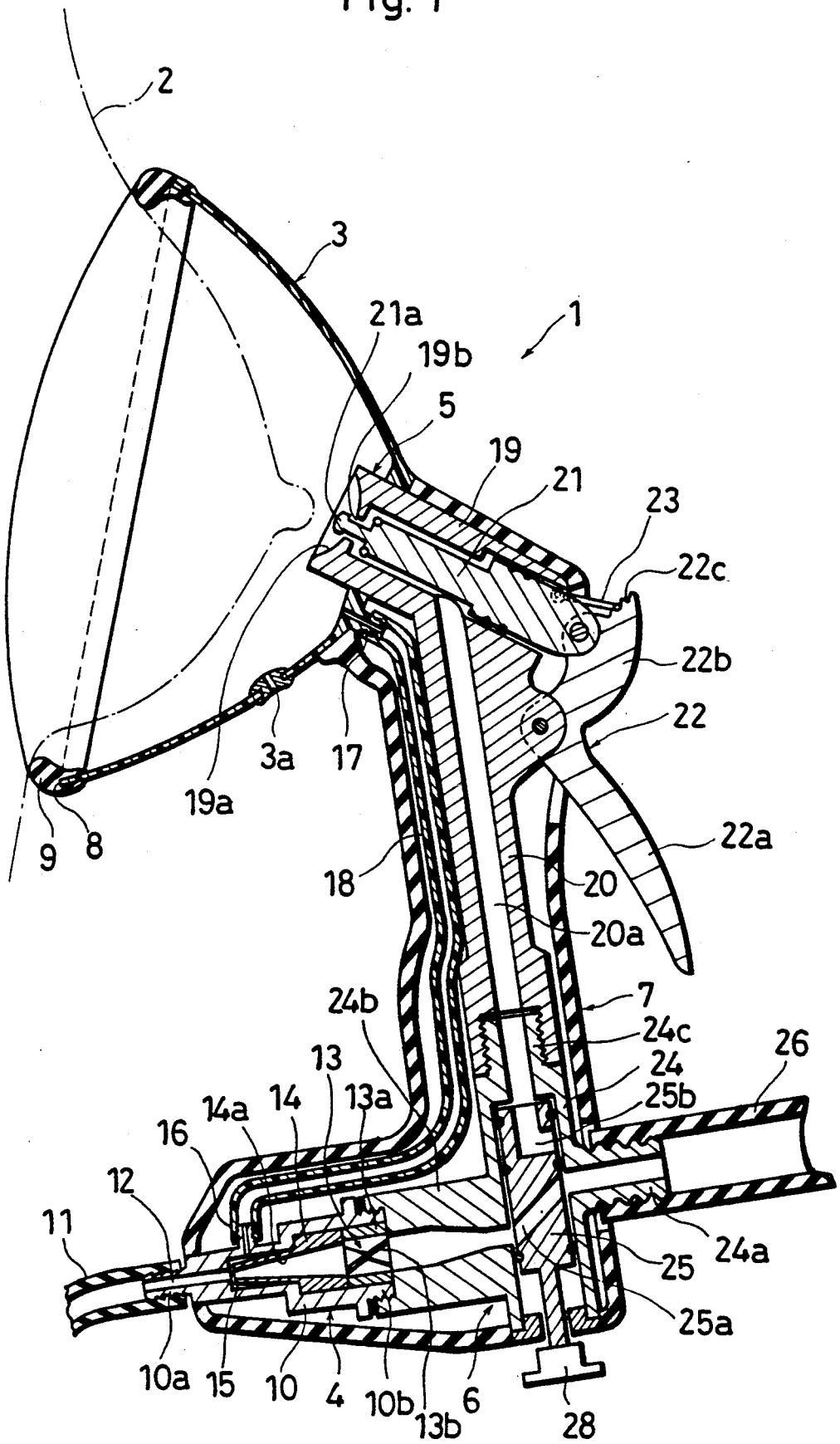
FIG. 1 is a view, in central section, showing a hydraulic breast enhancer according to the present invention in its operating condition for suction mode.

Referring now to FIG. 1 of the accompanying drawings, there is illustrated a breast enhancer which is generally represented by reference numeral 1. The enhancer 1 mainly includes an applicator cup 3 for accommodating the breast 2 of a user (woman usually), a negative pressure generator 4 for generating a negative pressure within the cup 3, a water spouting gun 5 for applying a water spout to the breast 2, a changeover valve 6 for selectively passing a water flow through the negative pressure generator 4 or the water spouting gun 5, and a housing 7 for supporting the cup 3 and accommodating the other components described above. Preferably, the housing 7 is so shaped as to provide a grip for the user.

The applicator cup 3 is generally conical to suitably receive the user's breast 2. The cup has an open mouth 8 which allows entry of the breast. Preferably, the open mouth of the cup is provided with an annular protection pad 9 made of a soft material such as silicone rubber, so that the cup does not injure the breast when suction is applied to the breast. The protection pad may be replaced by a differently sized and configured pad, so that the same cup may be used for a differently sized and contoured breast.

The applicator cup 3 is provided, at a suitable portion thereof, with a vacuum relief port 3*a* communicating with the interior of the cup. The relief port may be conveniently opened and closed with a finger (or thumb) to relieve and restore the suction force within the cup.

The negative pressure generator 4 includes a hollow generator body 10 having a discharge end 10*a* connected to a discharge hose 11. The discharge end 10*a* provides a water discharge port 12 communicating with the discharge hose 11. The generator body 10 further has an externally threaded inlet end 10*b* screwed to the changeover valve 6.

Within the inlet end 10*b* of the generator body 10 is fitted a flow swirler 13 which comprises a mounting ring 13*a* and a twisted plate 13*b* attached to the inner circumferential surface of the mounting ring 13*a*. The twisted plate 13*b* may have a twist angle of about 90° for example. The water passing through the swirler 13 is imparted a swirling motion while also being accelerated in flow speed.

Further, a flow accelerator 14 is fitted within the generator body 10 between the flow swirler 13 and the water discharge port 12. The accelerator 14 has a taper passage 14*a* which progressively reduces in diameter toward the water discharge port 12. Thus, the swirling water flow increases in speed upon passing through the accelerator.

An annular evacuating chamber 15 is formed around the flow accelerator 14 within the generator body 10. This evacuating chamber 15 communicates with the water discharge port 12. The generator body 10 is formed with a suction port 16 communicating with the evacuating chamber 15.

According to the Bernoulli theorem, when a non-viscous incompressible fluid flows in a steady state, the static pressure of flowing fluid decreases as the dynamic pressure thereof increases. The arrangement of the negative pressure generator 4 is such that the water entering from the flow swirler 13 increases greatly in flow speed before leaving the flow accelerator 14. Thus, the static pressure of the water flow decreases to generate a negative pressure within the evacuating chamber 15.

The applicator cup 3 is formed with a suction port 17 which is connected to the generator suction port 16 through a suction tube 18 extending within the housing 7. Thus, the negative pressure (vacuum) developed in the evacuating chamber 15 is applied to the interior of the cup 3.

The water spouting gun 5 comprises a gun cylinder 19 having a front end projecting into the applicator cup 3. The gun cylinder 19 is supported by a gun stem 20 which has a spout water passage 20*a* communicating with the changeover valve 6 and the interior of the gun cylinder.

The front end of the gun cylinder 19 has a spherically flaring spout mouth 19*a* which is immediately followed by a spout throat 19*b*. Within the gun cylinder 19 is slidably inserted an adjusting piston (gun piston) 21 having a headed front end 21*a* projectable from the spout throat 19*b*. Thus, the water spout generated by the gun 5 may be adjusted in flow intensity and orientation by altering the position of the piston front end 21*a* relative to the spout throat 19*b* (and the spout mouth 19*a* as well).

The adjusting piston 21 is slidably moved by a lever 22 which is pivotally supported by the gun stem 20. Specifically, the lever 22 is generally L-shaped to have an operating arm portion 22*a* and a responsive arm portion 22*b*. The operating arm portion 22*a* is located in a manner such that it can be manually operated while the user grips the housing 7. The responsive arm portion 22*b* is pivotally connected to the adjusting piston 21. Thus, the adjusting piston 21 can be slidably moved by manipulating the operating arm portion 22*a*.

Though not illustrated, the lever 22 is preferably spring-biased in a direction to slidably advance the adjusting piston 21, thereby facilitating manual operation of the lever. Further preferably, the responsive arm portion 22*b* of the lever 22 may be formed with engaging steps 22*c*, whereas the gun cylinder 19 pivotally carries a stopper ring 23 which is selectively engageable with the engaging steps 22*c*. In this way, the intensity and orientation of the water spout generated by the gun 5 may be adjusted stepwise. It is of course possible to steplessly adjust the water spout by pivoting the stopper ring 23 to a position out of interaction with the engaging steps 22*c*.

The changeover valve 7, which is in the form of a two-way valve, includes a valve casing 24 and a valve body 25 slidably movable within the valve casing. The valve casing 24 has an water inlet 24*a* connected through a hose 26 to a tap water faucet 27 (see FIG. 2). The valve casing further has a first outlet 24*b* screwed to the threaded inlet end 10*b* of the generator body 10, and a second outlet 24*c* screwed to the gun stem 20.

The valve body 25 has an obliquely extending first changeover passage 25*a*, and an L-shaped second changeover passage 25*b*. The valve body 25 is slidably moved by operating a knob 28 connected to the valve body and positioned outside the housing 7.

Figure 3:
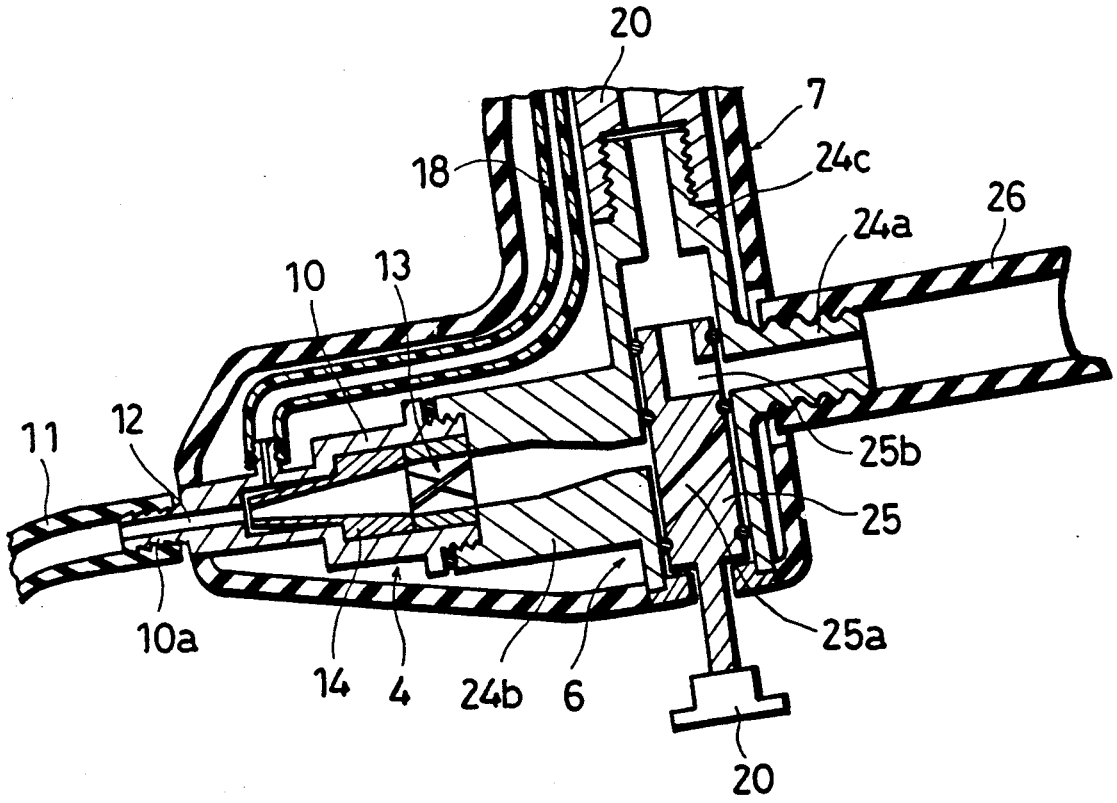
FIG. 3 is a sectional view showing a portion of the breast enhancer in its operating condition for water spouting mode.

According to the illustrated embodiment, when the valve body 25 is slidably pushed up by the knob 28, the first outlet 24*b* of the valve casing 24 conducts with the valve inlet 24*a* through the oblique passage 25*a* to pass the water flow through the negative pressure generator 4, as shown in FIG. 1. On the other hand, when the valve body 25 is slidably pulled down by the knob 28, the second valve outlet 24*c* communicates with the valve inlet 24*a* through the second changeover passage 25*b* to pass the water flow through the water spouting gun 5, as shown in FIG. 3. Thus, by operating the knob 28, it is possible to select between the suction mode and the water spouting mode.

The breast enhancer 1 described above is used in the following manner.

Figure 2:
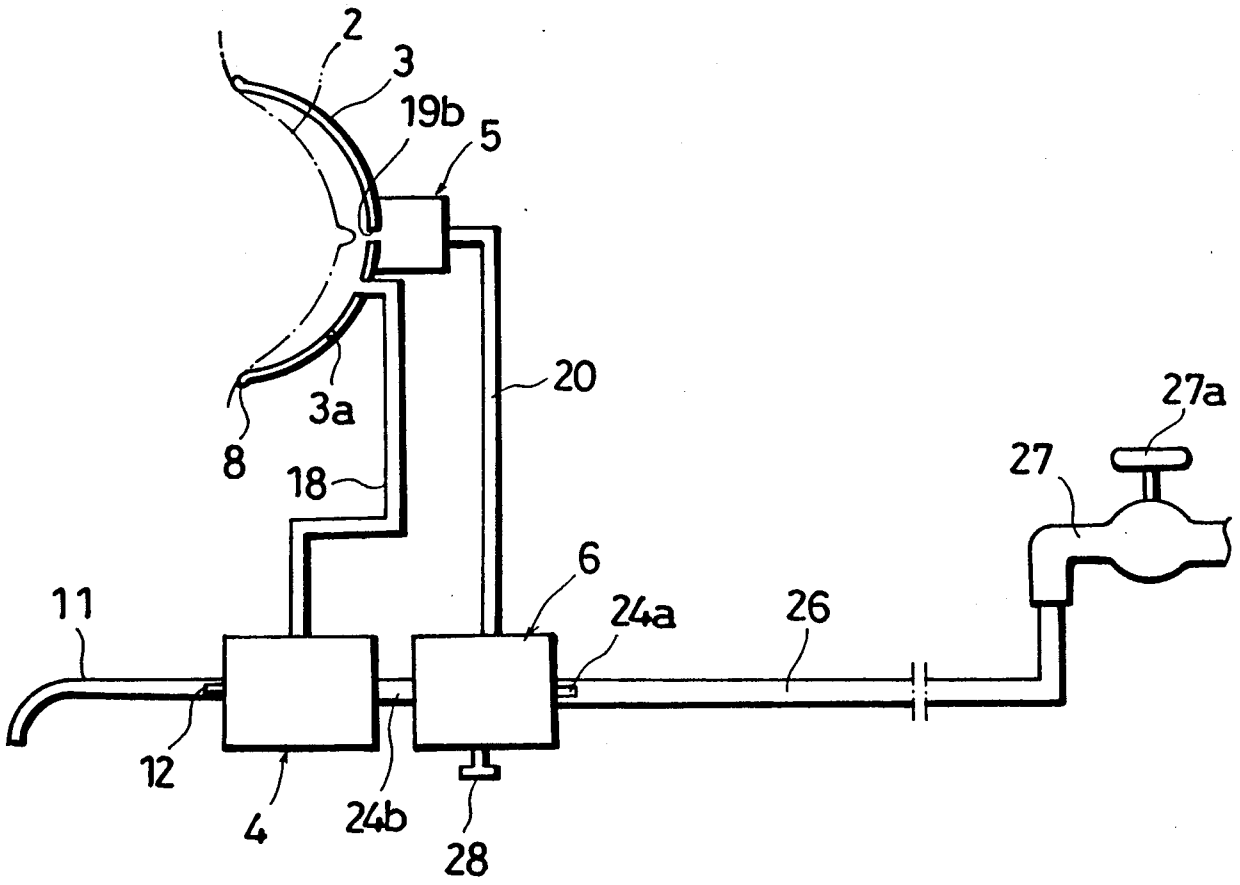
FIG. 2 is a schematic view showing how the breast enhancer is used.

As shown in FIG. 2, the breast enhancer may be put in a condition for use simply by connecting the valve water inlet 24*a* to the tap water faucet 27 through the hose 26. Preferably, the tap water faucet 27 is located in a place, such as bath room, which provides easy disposal of water. The discharge end of the water discharge hose 11 may be guided to a discharge sink (not shown) of the bath room. Alternatively, the discharge end of the water discharge hose 11 may be placed in a container to collect the discharged water for reuse to fill the bath tub.

The open mouth 8 (the protection pad 9) of the applicator cup 3 is held pressed against the chest, so that the breast 2 is received in the cup. Then, the knob 28 is operated to select the suction mode or the water spouting mode, and the valve 27*a* of the water faucet 27 is opened.

In the suction mode shown in FIG. 1, the water flow passes in the negative pressure generator 4 to discharge through the discharge hose 11. As already described, the water flow is accelerated in speed upon passage through the generator to develop a vacuum in the evacuating chamber 15. Thus, the interior of the applicator cup 3, which is connected to the generator through a suction tube 18, is evacuated to apply suction stimulation to the breast 2 when the vacuum relief port 3*a* of the cup is manually closed by the user. On the other hand, the suction application is immediately interrupted when vacuum relief port 3*a* is opened.

The flow rate of water passing through the negative pressure generator 4 may be steplessly varied by adjusting the faucet valve 27*a* (FIG. 2). Thus, it is possible to steplessly adjust the suction force within the applicator cap 3 because the intensity of the generated vacuum is dependent on the water flow speed. Alternatively, the suction force of the applicator cup may be steplessly altered by adjustably closing the vacuum relief port 3*a*.

In the water spouting mode shown in FIG. 3 (only showing the lower part of the breast enhancer), the water flow passes through the water spouting gun 5 (see FIG. 1) to discharge from the spout throat 19*b* toward the breast 2. The spouting water imparts pressing stimulation to the breast 2. The intensity and orientation (range) of the water spout may be adjusted by operating the lever 22 to alter the position of the headed front end 21*a* of the gun piston 21 relative to the spout throat 19*b* and the spout mouth 19*a*. It is therefore possible to optimize the pressing stimulation and to apply the pressing stimulation over the entire breast portion received in the applicator cup 3. Further, the faucet valve 27*a* (FIG. 2) may be operated to provide additional adjustability in the intensity of the water spout.

As described above, the breast enhancer according to the present invention is capable of selectively imparting suction stimulation and pressing stimulation relative to the breast 2 simply by operating the knob 28 of the changeover valve 6. Such operational mode selection is preferable for effective breast enhancement (enlargement and shape-up), and therefore advantageous over the conventional breast enhancers which are capable of providing either the suction stimulation or the pressing stimulation.

The breast enhancer of the present invention relies only on water flow for generating both of the suction stimulation and the pressing stimulation. Thus, the breast enhancer is simpler in structure, manufacturable at a lower cost and less susceptible to operational troubles than a one utilizing an electric motor. Further, the reliance on water flow allows the breast enhancer to be most conveniently used while the user takes a bath. In fact, the user is most relaxed with good blood circulation within the body when taking a bath, so that the bath time is the most suitable timing for performing the breast enhancement.

The present invention being thus described, it is obvious that the same may be varied in many ways. For instance, the changeover valve 6, which is of the slide type, may be replaced by a rotary type changeover valve. Further, the negative pressure generator 4 may be replaced by one utilizing a known venturi tube. Moreover, the water spouting gun 5 may be modified to generate water jets or any other forms of water spout. Such variations are not to be regarded as a departure from the spirit and scope of the invention, and all such modifications as would be obvious to those skilled in the art are intended to be included within the scope of the following claims.

I claim:

1. A hydraulic breast enhancer comprising:

an applicator cup shaped to receive a user's breast;

a negative pressure generator connected to said cup through a suction passage, said generator having a first water passage and being capable of evacuating the interior of said cup when water is passed through said first water passage;

a water spouting means connected to said cup and having a second water passage for spouting water toward the breast; and a changeover means connectable to a water supply source through a water supply passage which branches into said first and second water passages, said changeover means being located at a branching point for supplying water only to a selected one of said first and second water passages.

2. The breast enhancer according to claim 1, wherein said water spouting means is in the form of a water spouting gun which comprises a gun cylinder communicating with said second water passage, said gun cylinder having a spout opening positioned in said cup, said gun further comprising a gun piston slidably movable in said gun cylinder for adjusting the water spout discharged from said spout opening.

3. The breast enhancer according to claim 2, wherein said spout opening comprises a flaring spout mouth and a spout throat located immediately upstream from said mouth, said piston having a headed front end projectable from said spout throat, said headed front end being movable relative to said spout mouth and said spout throat for water spout adjustment.

4. The breast enhancer according to claim 2, wherein said piston is slidably movable by means of a lever which is provided with engaging steps selectively engageable with a pivotal stopper.

5. The breast enhancer according to claim 2, wherein said water spouting gun further comprises a gun stem, said second water passage extending through said gun stem.

6. The breast enhancer according to claim 1, wherein said negative pressure generator comprises: a hollow generator body having an inlet end connected to said changeover means, said generator body further having a discharge end connectable to a water discharge passage; a flow swirler fitted in said inlet end of said generator body for imparting a whirling motion to the water flow upon passage through said flow swirler; a flow accelerator fitted in said generator body between said flow swirler and said discharge end, said accelerator having a taper passage which progressively reduces in diameter toward said discharge end; and an annular evacuating chamber formed around said flow accelerator within said generator body, said evacuating chamber communicating with said suction passage.

7. The breast enhancer according to claim 1, wherein said cup is provided with a vacuum relief port which is manually openable and closable for relieving and developing a negative pressure within said cup.

8. The breast enhancer according to claim 1, wherein said changeover means is in the form of a changeover valve which comprises a valve casing and a valve body, said valve casing having a water inlet connectable to said water supply source, said valve casing having a first outlet connected to said first water passage and a second outlet connected to said second water passage, said valve body being operable to connect said water inlet selectively to said first and second water passages.

9. The breast enhancer as defined in claim 8, wherein said valve body is slidably movable in said valve casing by means of a knob.

10. The breast enhancer as defined in claim 1, further comprising a housing for accommodating said negative pressure generator, said water spouting means and said changeover means, said housing being also workable as a hand grip.

* * * * *